US008539695B1

(12) United States Patent
Gemmen

(10) Patent No.: US 8,539,695 B1
(45) Date of Patent: Sep. 24, 2013

(54) FOOTWEAR DEVICE

(76) Inventor: Greg Gemmen, Eugene, OR (US)

( * ) Notice: Subject to any disclaimer, the term of this patent is extended or adjusted under 35 U.S.C. 154(b) by 298 days.

(21) Appl. No.: 12/592,419

(22) Filed: Nov. 24, 2009

Related U.S. Application Data

(60) Provisional application No. 61/200,056, filed on Nov. 24, 2008.

(51) Int. Cl.
*A43B 3/12* (2006.01)

(52) U.S. Cl.
USPC ..... 36/11.5; 36/7.1 R; 36/7.5

(58) Field of Classification Search
USPC ..... 36/7.1 R, 7.2, 7.4, 7.5, 7.6, 7.7, 11.5
See application file for complete search history.

(56) References Cited

U.S. PATENT DOCUMENTS

| | | | | | |
|---|---|---|---|---|---|
| 494,598 | A * | 4/1893 | Russell | 36/11.5 |
| 536,812 | A * | 4/1895 | Mabee | 36/7.5 |
| 1,001,397 | A * | 8/1911 | Hernandez | 36/11.5 |
| 2,207,091 | A * | 7/1940 | Fetterling et al. | 36/7.5 |
| 2,292,770 | A * | 8/1942 | Platkin | 36/7.2 |
| 2,307,699 | A * | 1/1943 | Moen | 36/7.5 |
| 2,466,373 | A * | 4/1949 | Cain | 36/28 |
| 3,716,932 | A * | 2/1973 | Pakulak | 36/72 R |
| 3,914,882 | A * | 10/1975 | Greer | 36/62 |
| 5,359,789 | A * | 11/1994 | Bell | 36/7.6 |
| 5,463,823 | A * | 11/1995 | Bell et al. | 36/11.5 |
| 5,471,767 | A * | 12/1995 | Walker | 36/2.6 |
| 5,992,053 | A * | 11/1999 | Hansen | 36/7.5 |
| 6,981,340 | B2 * | 1/2006 | Evans | 36/7.2 |
| 2003/0000107 | A1 * | 1/2003 | Blackburn | 36/7.5 |
| 2004/0068890 | A1 * | 4/2004 | Palahnuk | 36/7.1 R |
| 2004/0074113 | A1 * | 4/2004 | Kim et al. | 36/135 |

* cited by examiner

*Primary Examiner* — Marie Patterson
(74) *Attorney, Agent, or Firm* — King & Partners, PLC

(57) ABSTRACT

A footwear device for releaseably receiving footwear that has an upper surface, a sole, and a heel. The footwear device includes a sole having an upper surface and a ground-engaging surface, a forefoot support member extending from the sole to form a first loop, a heel support member extending from at least one of the sole and the forefoot support member to form a second loop. When footwear is inserted into the footwear device, the forefoot support member overlaps at least a portion of the upper surface of the footwear, the heel support member overlaps at least a portion of the heel of the footwear, and the sole of the footwear device substantially covers the sole of the footwear to protect the same.

6 Claims, 4 Drawing Sheets

FOOTWEAR DEVICE

CROSS-REFERENCE TO RELATED APPLICATION(S)

This application claims the benefit of U.S. Provisional Application No. 61/200,056 filed Nov. 24, 2008—which is hereby incorporated herein by reference in its entirety.

BACKGROUND OF THE INVENTION

1. Field of the Invention

The present invention relates in general to a footwear device and, more particularly, to a footwear device configured to be worn over conventional climbing shoes and/or boots during, for example, a climbing session when a climber is not climbing (e.g., belaying, spotting, walking off, etcetera).

2. Background Art

Climbing shoes have been known in the art for years. While climbing shoes have been known in the art, issues relative to comfort, integrity and/or longevity remain largely problematic. In particular, to the best of Applicant's knowledge, traditional climbing shoes and/or boots are by design very tight and consequently can be very uncomfortable. As such, a climber will frequently and repeatedly change his/her shoes during a climbing session because a majority of the time is spent performing actions other than climbing.

The footwear device of the present invention allows a climber to comfortably wear his/her climbing shoes, during non-climbing actions, thus materially saving time and hassle.

The footwear device of the present invention also protects the rubber sole of the climbing shoe, which is important for maintaining the condition of the sole, leading to fewer costly and inconvenient rerands/resoles and better performance from the climbing shoe. Moreover, the footwear device of the present invention, keeps the sole of the climbing shoe clean during a climbing session, leading to better friction, performance, and safety.

It is therefore an object of the present invention to provide a footwear device that, among other things, remedies and/or minimizes the aforementioned detriments and/or complications associated with conventional climbing shoes.

These and other objects of the present invention will become apparent in light of the present specification, claims, and drawings.

SUMMARY OF THE INVENTION

In one embodiment, the present invention is directed to a footwear device for releaseably receiving footwear, the footwear having an upper surface, a sole, and a heel, the footwear device comprising: (a) a sole having an upper surface and a ground-engaging surface; (b) a forefoot support member extending from the sole to form a first loop; (c) a heel support member extending from at least one of the sole and the forefoot support member to form a second loop; and (d) wherein when the footwear is inserted into the footwear device: (i) the forefoot support member overlaps at least a portion of the upper surface of the footwear; (ii) the heel support member overlaps at least a portion of the heel of the footwear; and (iii) the sole of the footwear device substantially covers the sole of the footwear to protect the same.

In an additional embodiment, the ground-engaging surface of the sole of the footwear device includes means for enhancing traction.

In yet another embodiment, the upper surface of the sole of the footwear device includes means for cleaning the sole of the footwear.

In another embodiment, the forefoot support member is an elastomeric loop sized such that when the footwear is inserted into the footwear device, the forefoot support member exerts forces on the upper surface of the piece of footwear to releaseably retain the same.

In one embodiment, the forefoot support member includes a first strap and a second strap disposed on opposing sides of the sole of the footwear device, wherein each of the straps has a first end and a second end, wherein the first ends of both straps are fixed to the sole and the second ends of both straps include fasteners which cooperate together to adjustably secure the first strap to the second strap to form the first loop.

In yet another embodiment, the heel support member is an elastomeric loop sized such that when the footwear is inserted into the footwear device, the heel support member urges the footwear forwardly into the forefoot support member.

In an additional embodiment, the footwear device further includes one or more support members extending from the sole to the heel support member, wherein the one or more support members urge the sole of the footwear device upwardly when the footwear is inserted into the footwear device.

In another embodiment, the footwear device further comprises a pull loop extending from the heel support member for positioning the heel support member around the heel of the footwear when the footwear is inserted into the footwear device.

In yet another embodiment, the footwear device further comprises at least one indicia disposed on an outer surface of the forefoot support member.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be further understood that the invention is not necessarily limited to the particular embodiments illustrated herein.

The invention will now be described with reference to the drawings wherein.

DETAILED DESCRIPTION OF THE INVENTION

Figure 1:
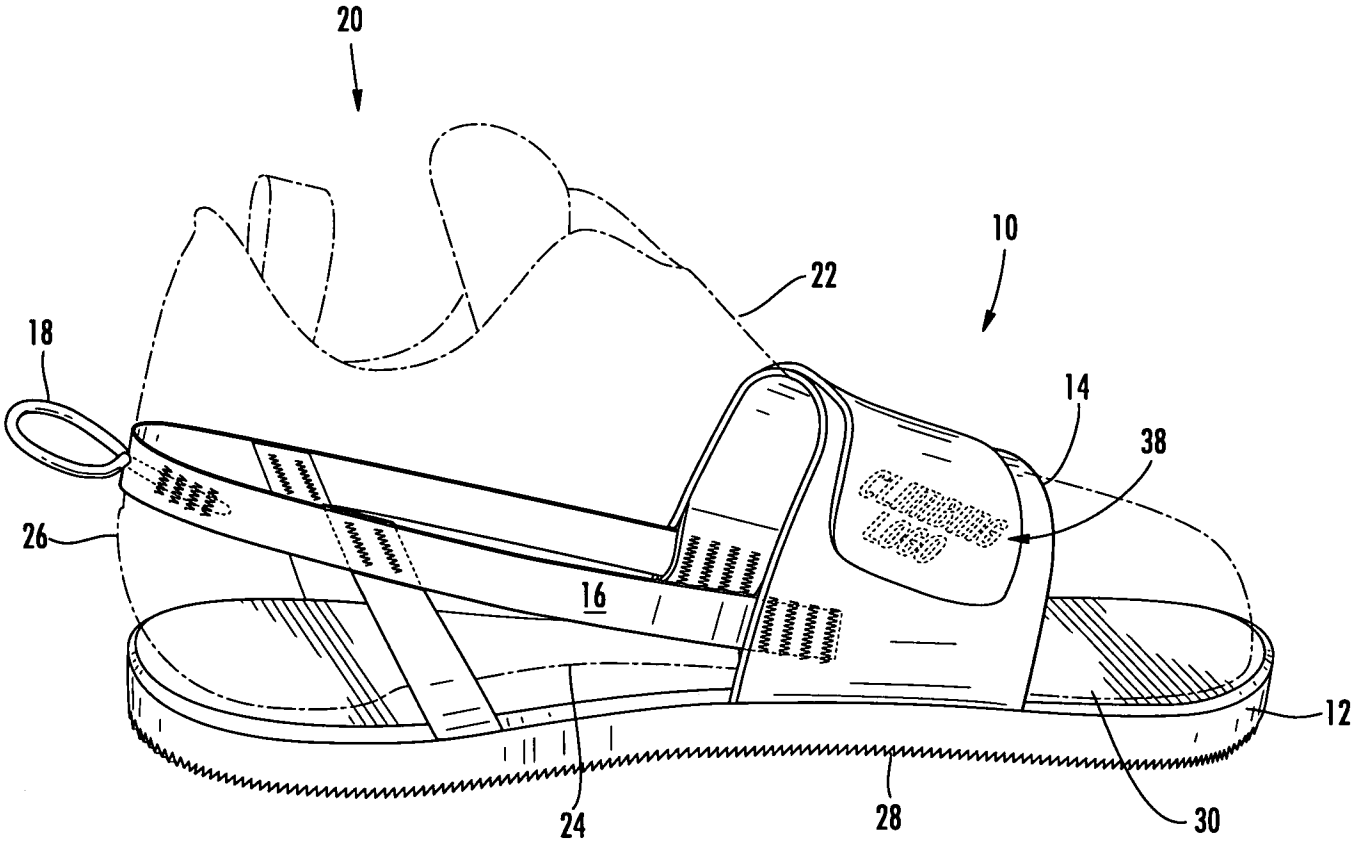
FIG. 1 of the drawings is a perspective view of a footwear device fabricated in accordance with the present invention in combination with footwear.
Figure 2:
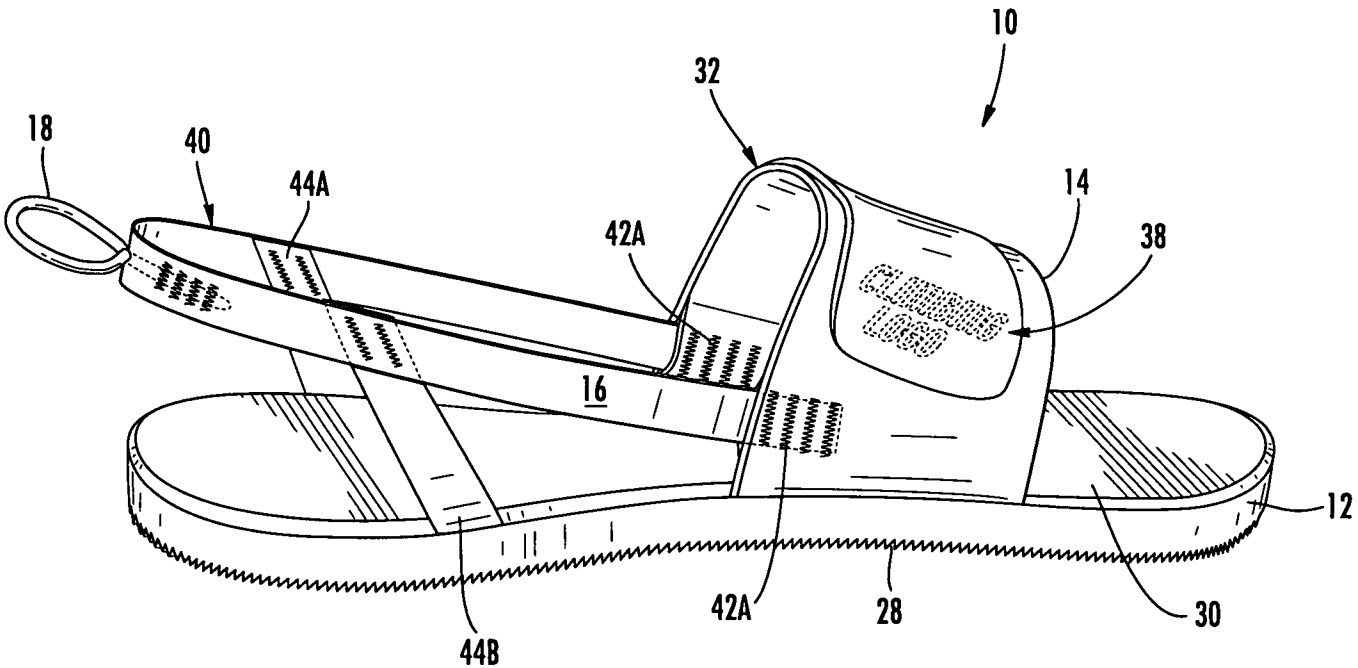
FIG. 2 of the drawings is a perspective view of a footwear device depicted in FIG. 1.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIG. 1 in particular, a perspective view of footwear device 10 is shown which generally comprises ground-engaging sole 12, forefoot support member 14, heel support member 16, and pull loop 18. It will be understood that footwear device 10 is generally adapted to releasably receive a piece of footwear 20 such as a climbing shoe or boot. It will be further understood that because footwear device 10 can be utilized in conjunction with a variety of footwear, only one particular application and type of footwear (e.g., climbing shoes) will be discussed in detail. In general, a climbing shoe, hereinafter referred to as footwear 20, includes upper portion 22, sole 24, and heel 26.

For purposes of the present disclosure, ground-engaging sole 12 preferably includes traction enhancing treads 28. While ground-engaging sole 12 has been disclosed for illustrative purposes as comprising treads, any one of a number of traction enhancing means are likewise contemplated for use in accordance with the present invention, including, for example, adhesive impregnated soles, studded soles, cleated soles—just to name a few.

At least a portion of upper surface 30 of ground-engaging sole 12 preferably comprises a soft cloth to brush clean the sole of footwear 20 and to keep grit from being forced against sole 24 of footwear 20.

In a preferred embodiment of the present invention, ground-engaging sole 12 comprises a lightly tractioned, cushioned sole that extends slightly beyond the length of footwear 20, and is adequate for up to at least Class 3 walkoffs.

Forefoot support member 14 preferably comprises, for example, an adjustable, elastic, and/or cushioned strap or band that is associated with ground-engaging sole 12. That is, forefoot support member 14 forms first loop 32 that is sized to receive a forward portion of footwear 20. More specifically, forefoot support member 14 overlaps at least a portion of upper portion 22 of footwear 20. It will be understood that forefoot support member 14 is configured to releasably receive a foot of a user—which may be bare, or covered, at least in-part, with a shoe or boot. Furthermore, forefoot support member 14 is sized such that it exerts forces on upper portion 22 of footwear 20 to releaseably retain the same.

Forefoot support member 14 is preferably adjustable via conventional hook and loop fasteners, buckles, strings, expanding and/or contracting members—just to name a few.

Figure 3:
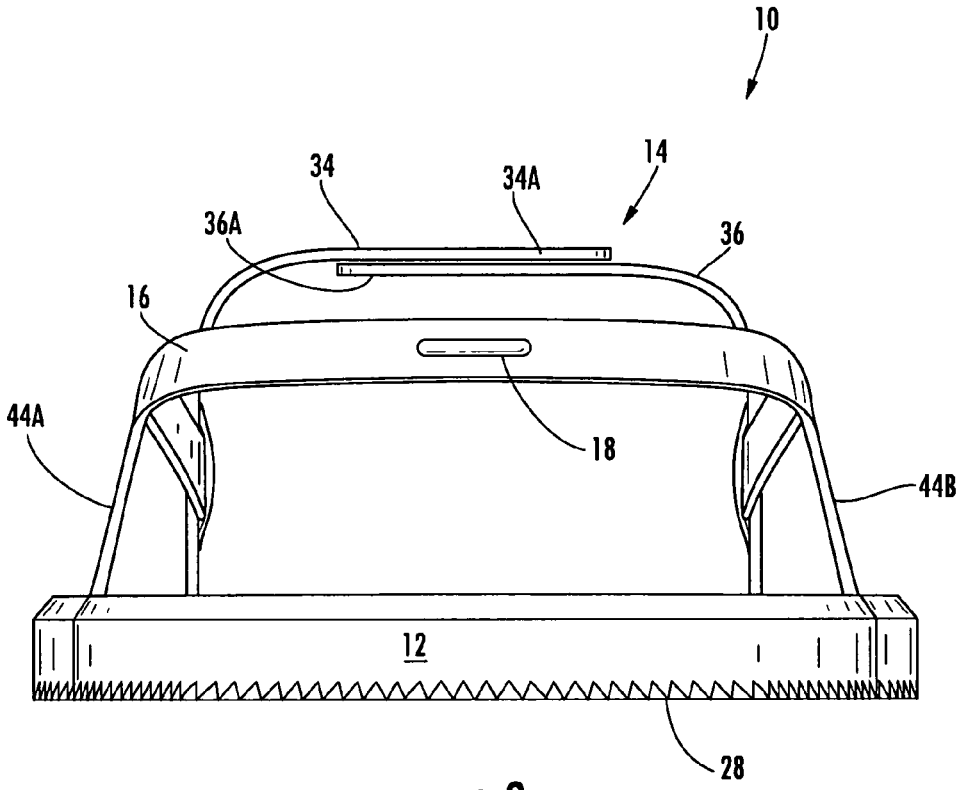
FIG. 3 of the drawings is a rear elevational view of the footwear device of FIGS. 1 and 2.
Figure 4:
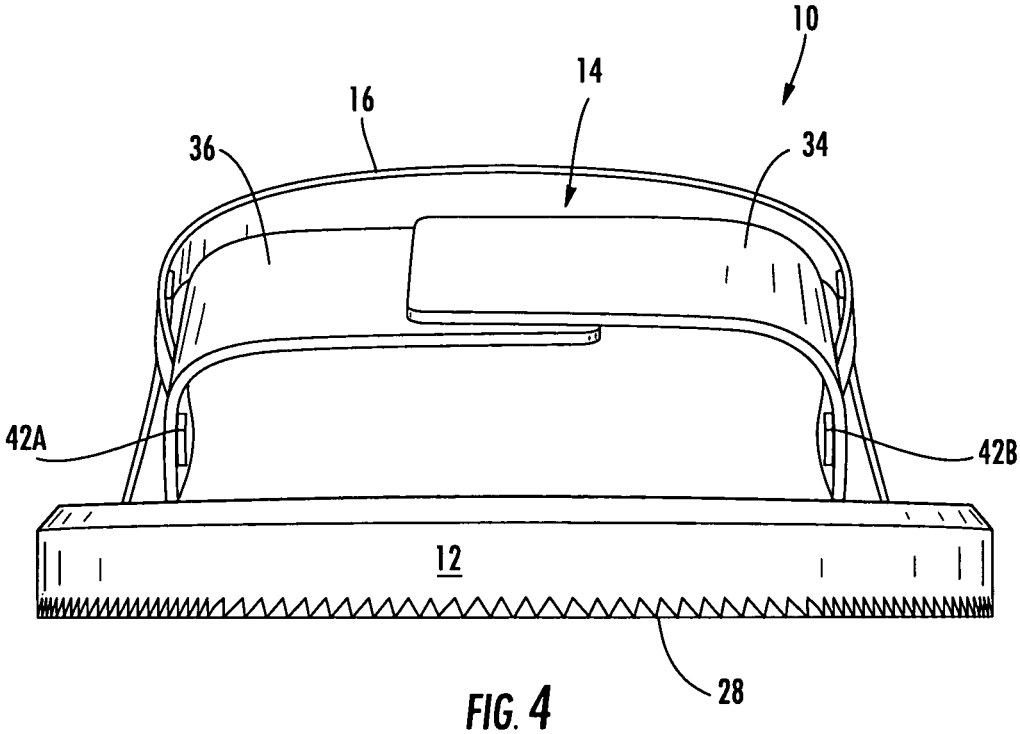
FIG. 4 of the drawings is a front elevational view of the footwear device of FIGS. 1-3.

In one embodiment, forefoot support member 14 includes first strap 34 and second strap 36 disposed on opposing sides of ground-engaging sole 12 of footwear device 10. The straps 34 and 36 are fixed at one end to opposing sides of ground-engaging sole 12 and the straps 34 and 36 each include second ends 34A and 36A (see FIG. 3) which are provided with fasteners (not shown) which cooperate together to adjustably secure first strap 34 to second strap 36 to form first loop 32. Fasteners include those as listed previously including hook and loop fasteners and the like.

Although not required, forefoot support member 14 is also preferably configured with an open toe design toward weight and contamination (e.g., grit, dirt, aggregate, debris, etcetera) minimization.

In another aspect of the present invention, forefoot support member 14 optionally comprises advertisement region 38, wherein indicia can be affixed, sewn, or otherwise associated with forefoot support member 14.

Heel support member 16 preferably comprises an elastic band that fits around heel 26 of footwear 20 to securely, yet releasably, fix the same into forefoot support member 14. Heel support member 16 is preferably attached to one or more of ground-engaging sole 12 and/or forefoot support member 14. In accordance with the present disclosure, heel support member 16 may extend from forefoot support member 14 to form second loop 40.

In one embodiment heel support member 16 is fabricated entirely from an elastomeric material. In an additional embodiment, heel support member 16 includes at least terminal ends 42A and 42B which are fabricated from an elastomeric material toward maximizing both user comfort and size flexibility.

Regardless of embodiment, heel support member 16 is preferably configured so that it can be easily pulled over heel 26 of footwear 20 and removed, thereby enabling the user to quickly and easily (e.g., with one hand) apply/remove footwear device 10 from each foot. It will be understood that heel support member 16 is preferably sufficiently wide so as not to dig into a climber's heel, thereby causing discomfort and/or broken skin.

Optional intermediate support members 44A and 44B are generally positioned between forefoot support member 14 and the rear most portion of heel support member 16. Intermediate support members 44A and 44B generally comprise vertical elastic bands which emanate from heel support member 16 to ground-engaging sole 12 and serve to minimize flip-flop type action of the device on the climber's foot when he/she is walking. That is, when footwear 20 is inserted into footwear device 10, intermediate support members 44A and 44B urge ground-engaging sole 12 upwardly to maintain contact between ground-engaging sole 12 and sole 24 of footwear 20 when the climber is walking.

In accordance with the present invention pull loop 18 is secured to heel support member 16 at its generally most rearward position. Pull loop 18 enables a climber to easily pull on footwear device 10 over footwear 20, as well as clip a pair of the footwear devices 10 to a carabineer. Preferably pull loop 18 is either sewn onto heel support member 14 and/or incorporated directly therein.

It will be understood that all components of footwear device 10 can be fabricated from conventional, natural and/or synthetics materials that would be known those having ordinary skill in the art having the present disclosure before them.

The foregoing description merely explains and illustrates the invention and the invention is not limited thereto except insofar as the appended claims are so limited, as those skilled in the art who have the disclosure before them will be able to make modifications without departing from the scope of the invention.

What is claimed:

1. A footwear device in combination with a footwear, the footwear having an upper surface, a back, a sole, and a heel, the footwear device, comprising:

a sole, wherein the sole includes a left side, a right side, an upper surface, and a ground-engaging lower surface, and wherein the ground-engaging lower surface includes treads;

a forefoot support member, wherein the forefoot support member includes a first strap having an upper surface, a lower surface, and a first chamber, wherein the first strap extends from the left side of the upper surface of the sole, and a second strap having an upper surface, a lower surface and a second chamber, wherein the second strap extends from the right side of the upper surface of the sole, and wherein the lower surface of the first strap and the upper surface of the second strap releasably contact each other to collectively form a first open toe loop;

an elastomeric heel support member, wherein the elastomeric heel support member includes a first end secured within the first chamber of the first strap of the forefoot support member and a second end secured within the second chamber of the second strap of the forefoot support member to form a first open heal loop;

a first intermediate support member, wherein the first intermediate support member extends from the left side of the upper surface of the sole to the elastomeric heel support member;

a second intermediate support member, wherein the second intermediate support member extends from the right side of the upper surface of the sole to the elastomeric heel support member;

wherein the forefoot support member contacts at least a portion of the upper surface of the footwear;

wherein the heel support member contacts at least a portion of the back of the footwear;

wherein a portion of the upper surface of the sole of the footwear device contacts the heel of the footwear; and wherein the upper surface of the sole of the footwear device substantially covers the sole of the footwear to protect the same.

2. The device of claim 1, wherein the upper surface of the sole of the footwear device includes means for cleaning the sole of the footwear.

3. The device of claim 1, wherein the forefoot support member is an elastomeric loop sized such that when the footwear is inserted into the footwear device, the forefoot support member exerts forces on the upper surface of the piece of footwear to releaseably retain the same.

4. The device of claim 1, wherein the heel support member is an elastomeric loop sized such that when the footwear is inserted into the footwear device, the heel support member urges the footwear forwardly into the forefoot support member.

5. A footwear device in combination with a footwear, the footwear having an upper surface, a back, a sole, and a heel, the footwear device, comprising:

a sole, wherein the sole includes a left side, a right side, an upper surface, and a ground-engaging lower surface, and wherein the ground-engaging lower surface includes treads;

a forefoot support member, wherein the forefoot support member includes a first strap having an upper surface, a lower surface, and a first chamber, wherein the first strap extends from the left side of the upper surface of the sole, and a second strap having an upper surface, a lower surface, and a second chamber, wherein the second strap extends from the right side of the upper surface of the sole, and wherein the lower surface of the first strap and the upper surface of the second strap releasably contact each other to collectively form a first open toe loop;

an elastomeric heel support member, wherein the elastomeric heel support member includes a first end secured within the first chamber of the first strap of the forefoot support member and a second end secured within the second chamber of the second strap of the forefoot support member to form a first open heal loop;

a first intermediate support member, wherein the first intermediate support member extends from the left side of the upper surface of the sole to the elastomeric heel support member;

a second intermediate support member, wherein the second intermediate support member extends from the right side of the upper surface of the sole to the elastomeric heel support member;

a pull loop, wherein the pull loop is attached to a rear portion of the elastomeric heel support member, and wherein the pull loop is positioned substantially parallel to the elastomeric heel support member;

wherein the forefoot support member contacts at least a portion of the upper surface of the footwear;

wherein the heel support member contacts at least a portion of the back of the footwear;

wherein a portion of the upper surface of the sole of the footwear device contacts the heel of the footwear; and wherein the upper surface of the sole of the footwear device substantially covers the sole of the footwear to protect the same.

6. A footwear device in combination with a footwear, the footwear having an upper surface, a back, a sole, and a heel, the footwear device, consisting of:

a sole, wherein the sole includes a left side, a right side, an upper surface, and a ground-engaging lower surface, and wherein the ground-engaging lower surface includes treads;

a forefoot support member, wherein the forefoot support member includes a first strap having an upper surface, a lower surface, and a first chamber, wherein the first strap extends from the left side of the upper surface of the sole, and a second strap having an upper surface, a lower surface, and a second chamber, wherein the second strap extends from the right side of the upper surface of the sole, and wherein the lower surface of the first strap and the upper surface of the second strap releasably contact each other to collectively form a first open toe loop;

an elastomeric heel support member, wherein the elastomeric heel support member includes a first end secured within the first chamber of the first strap of the forefoot support member and a second end secured within the second chamber of the second strap of the forefoot support member to form a first open heal loop;

a first intermediate support member, wherein the first intermediate support member extends from the left side of the upper surface of the sole to the elastomeric heel support member;

a second intermediate support member, wherein the second intermediate support member extends from the right side of the upper surface of the sole to the elastomeric heel support member;

a pull loop, wherein the pull loop is attached to a rear portion of the elastomeric heel support member, and wherein the pull loop is positioned substantially parallel to the elastomeric heel support member;

wherein the forefoot support member contacts at least a portion of the upper surface of the footwear;

wherein the heel support member contacts at least a portion of the back of the footwear;

wherein a portion of the upper surface of the sole of the footwear device contacts the heel of the footwear; and wherein the upper surface of the sole of the footwear device substantially covers the sole of the footwear to protect the same.

* * * * *